US005863298A

United States Patent [19]

Fulton et al.

[11] Patent Number: 5,863,298

[45] Date of Patent: Jan. 26, 1999

[54] METHOD FOR SIZING AND DESIZING YARNS WITH LIQUID AND SUPERCRITICAL CARBON DIOXIDE SOLVENT

[75] Inventors: John L. Fulton; Clement R. Yonker; Richard R. Hallen; Eddie G. Baker; Lawrence E. Bowman; Laura J. Silva, all of Richland, Wash.

[73] Assignee: Battelle Memorial Institute, Richland, Wash.

[21] Appl. No.: 811,747

[22] Filed: Mar. 6, 1997

Related U.S. Application Data

[63] Continuation-in-part of Ser. No. 613,272, Mar. 8, 1996, abandoned.

[51] Int. Cl.[6] ..... D06L 1/06

[52] U.S. Cl. ..... 8/138; 8/137; 8/142; 134/22.18

[58] Field of Search ..... 8/138, 137, 142; 134/22.18

[56] References Cited

U.S. PATENT DOCUMENTS

| | | | |
|---|---|---|---|
| 2,273,780 | 2/1942 | Dittmar | 524/272 |
| 4,401,782 | 8/1983 | Conklin et al. | 524/313 |
| 5,486,212 | 1/1996 | Mitchell et al. | 8/142 |
| 5,501,761 | 3/1996 | Evans et al. | 156/344 |

FOREIGN PATENT DOCUMENTS

| | | |
|---|---|---|
| 3904514 | 8/1990 | Germany . |
| 4004111 | 8/1990 | Germany . |

OTHER PUBLICATIONS

Gebert et al., Text. Prax. Int., pp. 627–629, Jul./Aug. 1993.

*Primary Examiner*—Alan Diamond
*Attorney, Agent, or Firm*—Douglas E. McKinley, Jr.; Paul W. Zimmerman

[57] ABSTRACT

Disclosed is a method of sizing and desizing yarn, or more specifically to a method of coating yarn with size and removing size from yarn with liquid carbon dioxide solvent.

17 Claims, 2 Drawing Sheets

METHOD FOR SIZING AND DESIZING YARNS WITH LIQUID AND SUPERCRITICAL CARBON DIOXIDE SOLVENT

This application is a continuation-in-part of application Ser. No. 08/613,272 filed Mar. 8, 1996 now abandoned.

This invention was made with Government support under Contract DE-AC06-76RLO 1830 awarded by the U.S. Department of Energy. The Government has certain rights in the invention.

FIELD OF THE INVENTION

The present invention relates generally to a method for sizing and desizing yarn, or more specifically to a method of coating yarn with size and removing size from yarn with a liquid or supercritical carbon dioxide solvent.

BACKGROUND OF THE INVENTION

Modern production methods for producing woven fabrics such as high speed air jet looms often require treatment of the fibers or yarns prior to weaving. This process, wherein the yarns are coated with material known as "size" is used to strengthen the yarns and improve their resistance to abrasion, thereby allowing them to withstand the stress of the weaving process. Typically, size is applied by drawing the yarns through a mixture of water and a sizing material soluble in water such as starch or polyvinyl alcohol. The yarn is thereby wetted and coated with the size material. Typically, the yarn is then subjected to a drying or heating process to remove the water, thus leaving a yarn coated with the size material for weaving. After weaving the yarns into a fabric, the size material is typically removed by placing the fabric in water and thus dissolving the size into the water.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1:
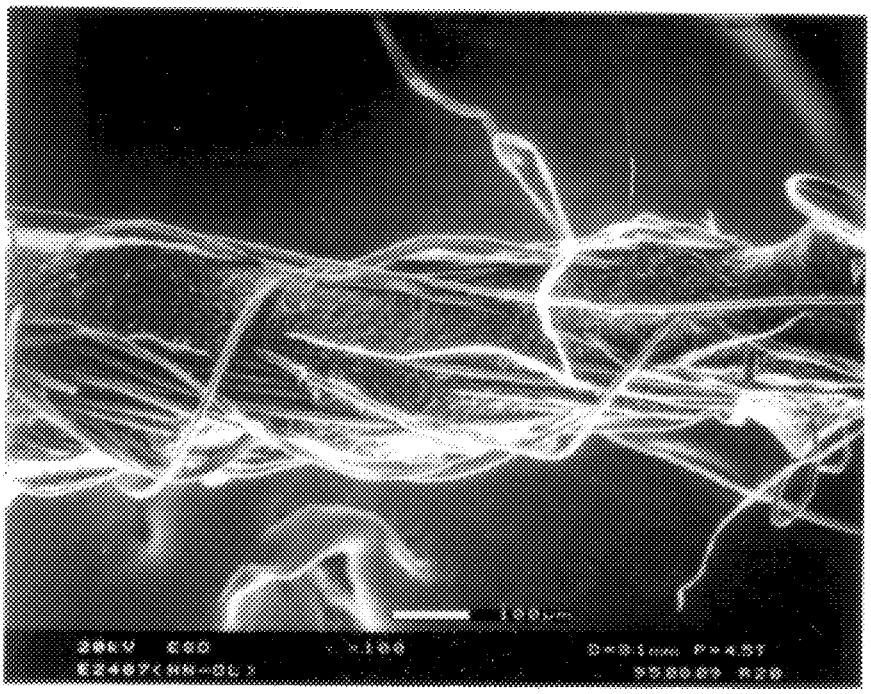
FIG. 1 shows an SEM of a yarn that was hot melt coated with the perfluoroalkanol.

In its broadest aspect, the present invention relates to a size material which is soluble in carbon dioxide, preferably liquid carbon dioxide ($LCO_2$). Such materials are referred to herein as "$CO_2$-phyllic", meaning they have an affinity for carbon dioxide and are readily soluble therein, and will be described in greater detail below. The carbon dioxide may be referred to as a "de-sizing" compound.

According to one aspect of the present invention, liquid carbon dioxide or supercritical carbon dioxide is provided as a solvent for size.

In a yet further aspect of the present invention, yarns are coated with size material by any of a variety of methods known in the art, including but not limited to, immersion and hot melt application. After the yarns are coated in the size material and woven into fabric, the fabric is made to come into contact with liquid or supercritical carbon dioxide in a pressurized vessel. The size is thereby dissolved into the carbon dioxide and is then removed from the fabric. The carbon dioxide and size are then either transferred from the pressurized vessel to an environment at a lower pressure, or the pressure within the pressurized vessel is reduced. At the lower pressure, typically atmospheric pressure, the carbon dioxide goes to a gaseous form, leaving the size material which may be recovered and reused.

In a yet further aspect of the present invention, yarns are placed in contact with the size in solution in liquid carbon dioxide or supercritical carbon dioxide within a pressurized vessel. The ratio of size to carbon dioxide can range between from a dilute to a saturated solution, or from about 5% carbon dioxide by weight to about 95% carbon dioxide by weight, preferably between about 50% carbon dioxide by weight to about 95% carbon dioxide by weight, depending on the particular size material selected.

The yarns are either then transferred from the pressurized vessel to an environment at a lower pressure, or the pressure within the pressurized vessel is reduced. At the lower pressure, typically atmospheric pressure, the carbon dioxide goes to a gaseous form, leaving the yearns coated with the size material.

Size materials may thus be selected as any polymeric material which is a solid at room temperature and is soluble in liquid or supercritical carbon dioxide and which adhere to the yarns or fishers selected (referred to herein as "$CO_2$-philic" sizes), and which perform the functions associated with fabric sizes, namely increased abrasion resistance, increased tensile strength, and greater elongation of fibers before breaking. Suitable polymers include, but are not limited to, polymers containing fluorine, such as: poly (perfluoro-alkyl acrylates), including poly(perfluoro-n-octyl acrylate) and poly(perfluoro-iso-octyl acrylate), poly (perfluoro-alkyl methacrylates), including poly(perfluoro-n-octyl methacrylate) and poly(perfluoro-iso-octyl methacrylate), poly(perfluoro-monocyclic acrylates), including poly(perfluorocyclohexyl acrylate), poly (perfluoro-monocyclic methacrylates) including poly (perfluoro-cyclohexyl methacrylate), perfluoropolyethers, and perfluoropolyesters.

The size may be the polymeric material or a combination of the polymeric material with other compounds wherein the compounds are selected from the group of adhesives, binders, waxes, lubricants, antioxidants, partially and fully fluorinated organic species, and combinations thereof. Waxes include perfluoroalkanes, perfluoroalkanols, and perfluoroesters; diblock species of the type $F(CF_2)_x(CH_2)_yH$, wherein x is between about 4 and about 30 and y is between about 4 and about 30 such as $F(CF_2)_8(CH_2)_{12}H$ (Chemical Abstract Registry #106873-67), $F(CF_2)_{10}(CH_2)_{12}H$ (Chemical Abstract Registry #93454-71-8), $F(CF2)_{12}(CH_2)_8H$ (Chemical Abstract Registry #90499-31, $F(CF_2)_{12}(CH_2)_{14}H$ (Chemical Abstract Registry #96454-73-0) and $F(CF_2)_{12}(CH_2)_{18}H$ (Chemical Abstract Registry #93454-75-2). Lubricants include polymers containing silicon such as poly(alkyl siloxanes), and polydimethyl siloxane; branched hydrocarbon polymers having molecular weights up to about 1,000. Additional compounds which may be added to the polymer include derivatives of polyvinyl alcohol, paraffins, waxes, tallows; and mixtures thereof. Additionally, size formations could include additives such as elastomers, tackifying resins, waxes, antioxidants, surfactants and mixtures thereof.

While polyester/cotton blend yarns were used to demonstrate sizing and desizing of the various size materials in a carbon dioxide solvent in the illustrative experiments which follow, as will be apparent to those skilled in the art, the scope of the present invention would include a broad array of yarns and fabrics coated with size materials including but not limited to cotton, wool, silk, synthetic fibers including carbon fiber, nylon, rayon, polyester, and combinations thereof.

EXAMPLE 1

An experiment was performed wherein a small number of candidate size compounds were selected and applied to polyester/cotton blend yarns. The candidate size compounds were applied separately and not in combination with other compounds. Sizing was accomplished using two different techniques: (1) immersion in a $LCO_2$ solution of the size compound, and (2) drawing the yarn through a hot melt of the size compound. Sized yarns were completely desized by rinsing or washing the yarns with pure $LCO_2$. All yarns were characterized with respect to tensile strength and modulus of elasticity using simple tests. Electron microscopy was used to qualitatively determine the degree of encapsulation and continuity of coating. Test size compounds were perfluorododecane, perfluorododecanol, a diblock species, and a fluoropolymer.

The diblock compound was 1,1,1-2,2-3,3-4,4-5,5-6,6-7,7-8,8 heptadecafluoroeicosane (Chemical Abstract Registry #106873-67).

The fluoropolymer was poly(perfluoro-n-octylacrylate) and was synthesized in supercritical carbon dioxide via a free radical initiated reaction. The free radical initiator, 2,2'-azobis(2-methylpropionitrile) (AIBN) Chemical Abstract Registry #78-67-1), was recrystallized in anhydrous methanol prior to use. Briefly, 85 mg of initiator (AIBN) and 8 g of perfluoro-n-oclylacrylate (Chemical Abstract Registry #307-98-2) monomer were loaded into a small autoclave with optical access. The autoclave was then sealed and pressurized with carbon dioxide while heating to 59.4° C. The pressure was maintained at 207 bar for 60 hours. During this time the reaction mixture remained colorless and transparent. Homogeneity was ensured by vigorous, magnetically-coupled stirring with a polytetrafluoroethylene (PTFE) coated stir bar. The polymer was collected by slowly venting the inverted autoclave into a large beaker. The collected polymer was thoroughly washed with methanol and dried in a vacuum oven to yield 8 g of viscous, nearly transparent polymer.

The high-pressure view cell used for these studies had a volume of approximately 20 mL, and was rated to 500 bar at 150° C. Optical access is through two 2.5-cm-diameter sapphire windows. Carbon dioxide was transferred to the pressure cell using a high pressure syringe pump. All experiments were performed at room temperature (~25° C.).

Yarns were coated with the $LCO_2$ soluble compounds by two methods. The first involved immersing the yarn in solution containing approximately 75% by volume size compound and 25% by volume $CO_2$. This was accomplished in the following manner. One gram of the compound was loaded into the autoclave. A short length of yarn was suspended within the autoclave such that the yarn was kept above the size-$LCO_2$ solution until it was ready to be immersed. The autoclave was sealed and purged of air using $CO_2$ vapor. Pressure was increased by the addition of $CO_2$ gas until the minimum pressure required to solvate the compound was reached. The volume of the liquid solution in bottom of the autoclave was typically on the order of 1.5 mL The cell was inverted to immerse the yarn in the solution, then restored to its original orientation and allowed to drain momentarily. The $CO_2$ gas was then quickly released, causing the solute material to solidify on the yarn. The yarn was removed from the autoclave and characterized.

The second method for applying the size compounds was by hot melt. Each of the size materials were melted by heating over a boiling water bath. Once the compound was melted, a length of yarn was gently pulled through the low viscosity melted compound. The yarn was squeezed between the tip of a spatula and a glass surface. The size cooled quickly in air and solidified such that a smooth, uniform coating of size was obtained.

A simple method was developed to simulate the abrasion experienced by the warp yarns during weaving. The yarn was pulled three times over a 90° edge having a corner radius of 0.5 mm. Following this simple modeling of yarn abrasion the mechanical properties of the yarn were determined again.

The removal of size from the sized yarns was determined gravimetrically. Prior to any processing, the virgin yarn was washed in $LCO_2$ to remove any $CO_2$-soluble compounds that might be washed off in subsequent processing, thereby avoiding inflated values for the percentage of size removal. The yarn was then weighed prior to and following coating by one of the size materials in the manner described above. Lastly, the yarn was washed with pure $LCO_2$ to remove the applied size, and then re-weighed. Any differences in the mass of the yarn between pre-sized and de-sized processes would represent size material that was not fully removed during the washing process.

The ultimate tensile strength the of sized yarns was determined using simple tests. Small stainless steel clamps were used to attach the yarn under test between a fixed point and a free weight. Mass was slowly added to the free end until the load required to break the yarn was reached.

A composite modulus-of-elasticity of the yarn/size matrix was measured using a simple deflection test. This was accomplished by recording the micro-deflection of a horizontally mounted yarn with one end free. The applied load was simply the yarn's weight per unit length. Measurements were made on at least three, 4 cm-long yarns. The mean value is reported. The modulus-of-elasticity, E, was determined using the following relationship:

$$E = \frac{-wl^4}{30yI}$$

where w is the weight per unit length, 1 is the yarn length, y is the measured deflection, and I is the moment of inertia about the central axis.

Scanning electron microscopy was used to qualitatively characterize the degree of encapsulation and continuity of coating. Two systems were used 1) an environmental scanning electron microscope, and 2) a conventional scanning electron microscope.

Some of the compounds deposited on the yarn were brittle in nature and not firmly bound to the yarn suggesting advantages of combining these compounds with a film former in a size formulation that would firmly bind to the yarn. This is especially true where the brittle nature was most apparent with the perfluoroalkane and diblock and less evident with the perfluoroalkanol. The fluoropolymer was slightly tacky and formed a smooth, uniform coating on the yarns indicating its useful properties as a film former. It appeared to strongly adhere to or encapsulate the yarn and was not readily removed.

Figure 2:
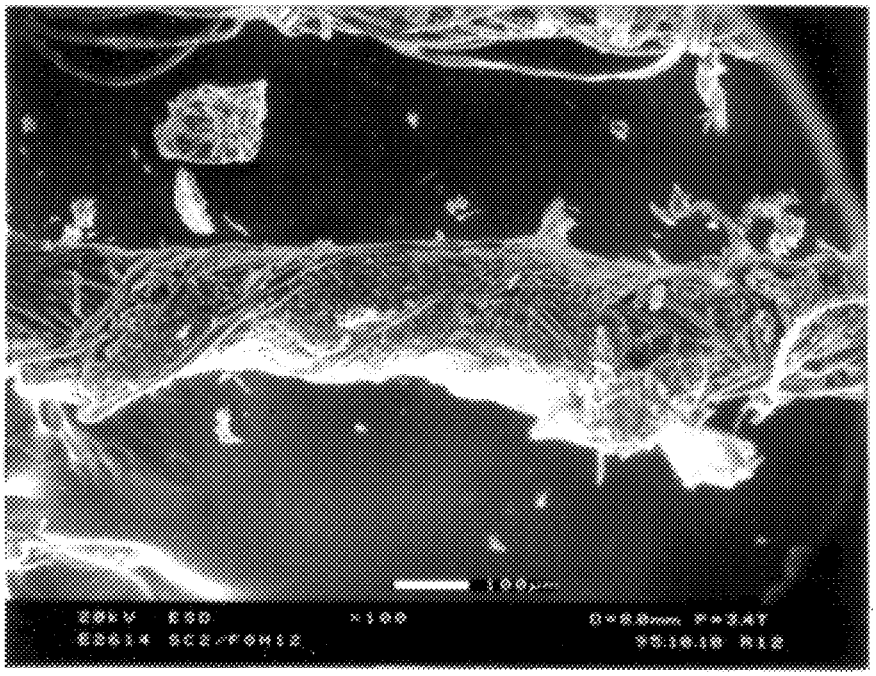
FIG. 2 shows an SEM of a yarn that was hot melt coated with the diblock compound.
Figure 3:
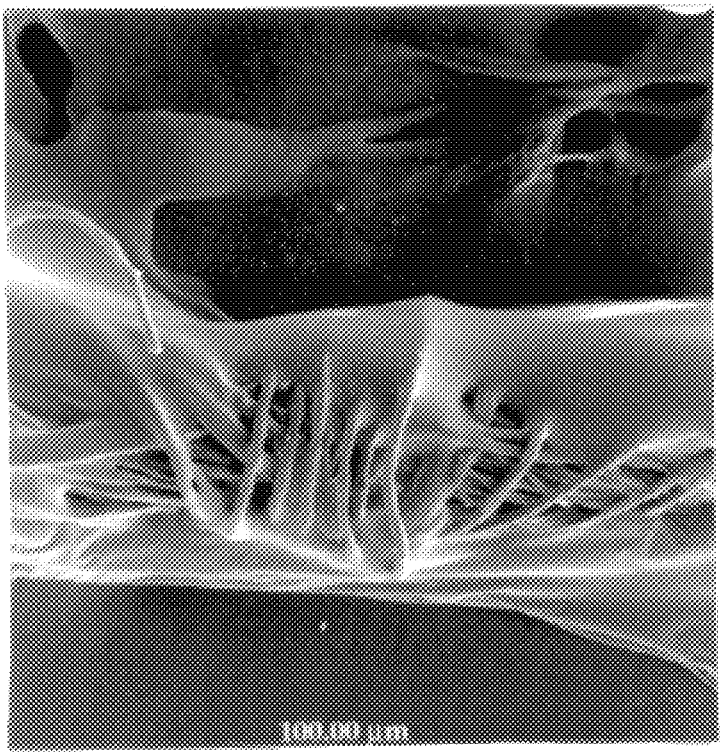
FIG. 3 shows a conventional scanning electron microscope view of a yarn first coated with fluoropolymer using the hot melt method then sputtered with gold.

Scanning electron micrographs (SEMs) were obtained of the sized yarns using the environmental scanning electron microscope. For a given compound, the general characteristics revealed in the SEMs of yarns sized with the immersion method and hot melt method were similar. SEMs of yams sized with three different size materials are shown in FIGS. 1, 2, and 3. FIG. 1 shows an SEM of a yarn that was hot melt coated with the perfluoroalkanol. A smooth, uniform coating is evident. There appears to be some penetration of this material between the individual fibers. In addition, in this experiment the coating did not completely encapsulate the yarn as is seen that individual fibers protrude through the coating. Addition of a film former to the perfluoroalkanol is believed to overcome this coating problem.

An SEM of a diblock coated yarn is shown in FIG. 2. This yarn was sized using the immersion method. The coating is reasonably uniform in the center of the photograph, but bare regions are observed on the extreme left and right. These regions resulted from handling the yarn while mounting it for examination with the electron microscope. This, in part, demonstrates the weak bond between the yarn and this size compound. Flakes of the size lost in this manner can be seen on either side of the yarn. It is believed that addition of a film former to the diblock would demonstrate a stronger bond. Yarns sized with perfluoroalkane appeared similar to the diblock sized yams when viewed through an optical microscope.

An image of fluoropolymer coated yarn was obtained using the conventional scanning electron microscope once the yarn was sputtered with gold (ca. 2 Å thickness). This image is shown in FIG. 3. The hot melt method was used to coat this yarn. The smooth, uniform polymer coating is evident along the entire length of the imaged region. The exposed fibers in the center of the image are indicative of points of contact with the apparatus used to squeegee excess size from the yarn.

In this experiment, the coating applied via hot melt or $LCO_2$ was heavier than the conventionally sized counterpart. This is primarily a result of the specific conditions used in applying these size compounds. The extent of add-on in this work is controlled by the squeezing pressure in the hot melt application of size materials or by the concentration of the size in the $LCO_2$ immersion approach. Commercially sized yarns also tend to have size encapsulating and penetrating individual fibers in the yarn. This characteristic may also be the case for the instant invention. As will be apparent to those skilled in the art, refining these methods should yield a thinner, more uniform coating of size on the yarn.

The results of the modulus of elasticity are presented in Table 1. The perfluoroalkanol stiffened the yarn, showing modulii of 18,000 for the solution sized and 73,000 for the hot melt sized. However, after the abrasion test, a reduction in the modulus and the mass of the sized yarn was observed. The conventionally sized yarns also experienced a decrease in elastic modulus upon abrasion. The modulus of the fluoropolymer sized yarns was not determined after the abrasion test as they tended to break during the test due to adhesion to the test apparatus. It is interesting to note that abrasion resulted in very similar elastic modulii for the yarn solution coated with perfluoroalkanol and the conventionally sized yarn. Although in the former case the addon was higher.

Table 1 also shows the results of the tensile strength measurements. All of the tested compounds provided increases in the tensile strength of the yarns. The greatest improvement was obtained with the hot melt applied perfluoroalkanol and fluoropolymer. These provided nearly 60% of the increase in tensile strength imparted by the conventional size. The other compounds provided increases ranging from 7 to 42%.

Experiment 2

An experiment was conducted to demonstrate carbon dioxide desizing of yarns sized in Example 1. The results of the desizing study are given in Table 2. The perfluoroalkanol and diblock were completely extracted from the yarns. However, the perfluoroalkane was not completely removed. Just 6.8% of this material remained on the yarn after washing with $LCO_2$. The perfluoroalkane was slightly discolored upon receipt, presumably due to an impurity. This impurity caused a reddish brown stain on the test yarn which may account for the incomplete extraction of size as measured by the slight increase in mass.

TABLE 1

Mechanical properties of sized yarns.

| Size Compound | Mass of Uncoated Yarn (mg) | Mass of Coated Yarn (mg) | Mass of Coated Yarn After Abrasion (mg) | Elastic Modulus | Elastic Modulus After Abrasion | Tensile Strength Before Abrasion (g) |
|---|---|---|---|---|---|---|
| Solution Coated | | | | | | |
| 1H, 1H, 2H, 2H, Perfluoroalkanol† | 1.2 ± 0.2 | 3.8 ± 0.9 | 2.3 ± 0.4 | 18,000 ± 1,500 | 4,200 ± 2,300 | 340 ± 50 |
| Diblock* | 1.2 ± 0.2 | 5.1 ± 1.8 | 1.8 ± 0.2 | 3,200 ± 700 | 1,300 ± 230 | 260 ± 50 |
| Perfluoroalkane† | 1.2 ± 0.2 | 4.8 ± 1.0 | 2.1 ± 0.3 | 9,200 ± 900 | 1,900 ± 700 | 260 ± 70 |
| Conventional size* | — | 1.2 ± 0.2 | 1.3 ± 0.2 | 13,000 ± 5800 | 4,300 ± 1,300 | 420 ± 10 |
| Bare Yarn* | 1.2 ± 0.2 | — | 1.2 ± 0.2 | 600 ± 40 | 560 ± 50 | 230 ± 10 |
| Hot Melt Coated | | | | | | |
| 1H, 1H, 2H, 2H, Perfluoroalkanol* | 1.2± 0.2 | 8.6 ± 0.7 | 4.2 ± 0.7 | 73,000 ± 28,000 | 15,000 ± 11,000 | 360 ± 8 |
| Diblock* | 1.2 ± 0.2 | 5.6 ± 0.7 | 2.7 ± 0.5 | 3,700 ± 1,700 | 950 ± 200 | 240 ± 30 |

TABLE 1-continued

Mechanical properties of sized yarns.

| Size Compound | Mass of Uncoated Yarn (mg) | Mass of Coated Yarn (mg) | Mass of Coated Yarn After Abrasion (mg) | Elastic Modulus | Elastic Modulus After Abrasion | Tensile Strength Before Abrasion (g) |
|---|---|---|---|---|---|---|
| Perfluoroalkane* | 1.2 ± 0.2 | 5.4 ± 2.1 | 3.1 ± 0.9 | 7,300 ± 4,000 | 2,200 ± 650 | 320 ± 30 |
| Fluoropolymer† | 1.2 ± 0.2 | 5.7 ± 2.0 | — | 2,300 ± 700 | — | 360 ± 30 |

*Four Samples Tested
†Five Samples Tested
Mean values are reported with uncertainties given as one standard deviation.

TABLE 2

Results of de-sizing study.

| Size Compound | Initial Mass of Yarn (mg) | Mass of Coated Yarn (mg) | Mass of Yarn after $LCO_2$ extraction (mg) | Residual Mass on Yarn (mg) |
|---|---|---|---|---|
| 1H, 1H, 2H, 2H, Perfluoroalkanol | 4.3 | 29.3 | 4.3 | 0.0 |
| Diblock | 3.6 | 36.0 | 3.6 | 0.0 |
| Perfluoroalkane | 3.9 | 32.2 | 6.1 | 2.2 |
| Fluoropolymer | 2.7 | 25.2 | 2.7 | 0.0 |

Experiment 3

In addition to the process for applying and removing size materials disclosed above, Applicant has discovered yet another new class of size materials—a blend of poly (perfluoro-n-octylacrylate) (PFOA) and perfluorododecanol. The glass transition temperature (Tg) of this polymer is approximately 0° C., indicating that it is elastic at room temperature. However, PFOA is somewhat sticky, making it difficult to work with in industrial environments. However, Applicant has discovered that by blending PFOA with perfluoroalcohols, much of the sticky nature of the polymer is ameliorated, and the polymer becomes waxy-like to the touch. The result is a size formulation that is elastic, has excellent abrasion resistance, and is soluble in liquid $CO_2$.

As set forth in Table 3 below, a number of size formulations were again tested on 1" yarn pieces, for indices of size effectiveness, including:

(1) mean number of abrasions at break using a Ruti-Webb abrasion tester (initial stress was 7.6 Newtons across 15 samples, the cyclical elongation was 0.5% of the 500 mm sample length, and the abrasion rate was 335 cycles per minute; and (2) tensile strength and elongation-at-break measurements were performed with a Tenius Olsen Universal Testing Machine, Model 2100, using a 20 pound load cell, operated at approximately 10% force range and 0–0.05" extension, with a cross head velocity of 0.5 inches per minute.

All yarn used in this test was from the same spool of unsized 50/50 polyester-cotton 35,1 MJS. It was found that blending PFOA with PFCA increases the abrasion resistance and elongation at break, and increases the tensile strength. Abrasion resistance increases as the amount of PFOA in the blend increases, while the presence of perfluoroalkanol in the blend markedly increases the abrasion resistance (as measured by the number of abrasion cycles normalized to the add-on). This is further evident from the results of the PFOA-PFOM-PFDD-OH (45:45:10) blend, which exhibits an abrasion-to-add-on ratio of over 100. The 80:20 blend of PFOA-PFDDOH exhibits even higher abrasion resistance relative to the other formulations. It is believed that the wax-like effect of the perfluoroalkanol on the PFOA combines with the elastic nature of the PFOA to produce the greatly enhanced abrasion resistance.

Therefore, because certain polymeric film formers, such as poly(perfluoro-n-octyl acrylate), exhibit a level of stickiness when applied to yams, their usefulness as sizes may be limited unless the size compound also contains a stickiness inhibitor. While those skilled in this art will recognize a number of potential stickiness inhibitors, Applicant has identified alcohols as useful for such purpose.

TABLE 3

| Size Formulation | Mean # Abrasions at Break | Add-On (wt %) | # Abrasions % Add-On | Tensile Strength* | % Elongation at Break* |
|---|---|---|---|---|---|
| PFCA, 100% | 320 +/− 37 | 102 | 3 | 339 +/− 47 | 12 +/− 2 |
| PFCA—PFOA, 76:24 | 624 +/− 94 | 133 | 5 | 389 +/− 54 | 14 +/− 2 |
| PFCA—PFOA, 65:35 | 1816 +/− 212 | 117 | 16 | 391 +/− 53 | 15 +/− 2.3 |
| PFCA—PFOA, 60:40 | 1930 +/− 439 | 135 | 14 | 382 +/− 64 | 17 +/− 3.7 |
| PFCA—PFOA, 50:50 | 11577 +/− 1459 | 179 | 65 | 340 +/− 47 | 20 +/− 3.4 |
| " w/ Tr PFHD-OH | | | | | |
| PFCA—PFOA, 50:50 | 1939 +/− 104 | 104 | 50 | 317 +/− 17 | 20 +/− 2.5 |

TABLE 3-continued

| Size Formulation | Mean # Abrasions at Break | Add-On (wt %) | # Abrasions % Add-On | Tensile Strength* | % Elongation at Break* |
|---|---|---|---|---|---|
| in FC-113 | | | | | |
| PFOA—PFOM—PFDD—OH, 45:45:10 | | | | | |
| 3.5% soln in FC-113 | 3036 +/− 946 | 28 | 110 | 328 +/− 55 | 17 +/− 2.3 |
| 5% soln in FC-113 | 3943 +/− 631 | 35 | 113 | 342 +/− 41 | 18 +/− 1.9 |
| 6.5% soln in FC-113 | 4559 +/− 787 | 44 | 103 | 349 +/− 52 | 18 +/− 2.5 |
| PFOA—PFDDOH, 80:20 | 7125 +/− 1362 | 28 | 254 | 300 +/− 48 | 20 +/− 2.4 |
| 6% soln in FC-113 | 7724 +/− 417 | 28 | 213 | 310 +/− 37 | 20 +/− 2.9 |
| 5% soln in FC-113 | 6459 +/− 339 | 10 | 230 | 346 +/− 48 | 20 +/− 3.1 |
| 4% soln in FC-113 | 6449 +/− 244 | 22 | 290 | 307 +/− 39 | 21 +/− 2.5 |
| 2% soln in FC-113 | 2707 +/− 161 | 36 | 260 | 293 +/− 48 | 19 +/− 2.2 |
| CONTROL YARN: | | | | | |
| PVA/Starch, 60:40 | 338 +/− 25.3 | 7.7 | 44 | 337 +/− 41 | 9.5 +/− 1.4 |
| PVA/Starch, 60:40 | 730 +/− 108 | 11.2 | 65 | 349 +/− 48 | 10 +/− 1.5 |
| BARE YARN (unsized) | negligible (<50) | — | — | 202 +/− 19 | 9 +/− 0.8 |

NOTE:
PFCA = poly(perfluorocyclohexylacrylate)
PFOA = poly(perfluoro-n-octylacrylate)
PFOM = poly(perfluoro-n-octylmethacrylate)
PFHD—OH = perfluorhexadecanol
PFDD—OH = perfluordodecanol
PVA = poly (vinyl alcohol)
* = mean of at least 20 samples It is readily apparent that a number of $CO_2$-soluble size compounds may be formulated which perform as well as or better than conventional aqueous-base sizes. It is believed that the best mode of practicing the invention will be to apply the size to the yarn before weaving, and remove the size prior to dying. The size may be removed either on-the-fly prior to rolling up, or from a roll of fabric. While it is believed that machines can be constructed to effect the size removal of the present invention on-the-fly, it will be significantly easier, from both an engineering and a production point of view, to remove the size from a roll of fabric. Heretofore, size has generally been removed on-the-fly because of the difficulty in getting the size solvent through the roll of fabric. As illustrated below in Experiment 4, Applicant has demonstrated that the $CO_2$-soluble sizes of the present invention may be removed from a roll of greige good fabric using $CO_2$.

Experiment 4

Three fabric coupons with "X"s of size applied thereto were placed on a large (72"×40") piece of fabric which was then folded and tightly rolled around a stainless steel screen core and held in place with clamps. The roll was placed in a 1 L autoclave and extracted with $CO_2$. The autoclave was heated to 60° C. and pressurized with carbon dioxide to 207 bar (3,000 psi). A preheater was used to heat the feed of $CO_2$ to the extraction temperature. One kilogram of $CO_2$ was flowed through the apparatus in stepwise fashion over four hours by causing the $CO_2$ to flow radially from outside the fabric to the inner core, and extracted out from the core. The autoclave was depressurized and allowed to cool, and the fabric was removed and unrolled and the fabric coupons were dyed using a disperse dye followed by a reactive dye with an intermediate reduction clearing treatment. No traces of the "X" patterns could be observed in the dyed fabric coupons.

It is to be understood that the size compounds set forth herein may be applied to yarns by hot-melt techniques well known to those skilled in this art. The range of possible size materials will be increased to some degree if the size is applied in a mixture of carbon dioxide and a co-solvent miscible with carbon dioxide. It is contemplated that such mixtures will contain carbon dioxide as the substantial majority consituent with the co-solvent in a relatively small portion. For example, a 95% solution of carbon dioxide and 5% pentane will increase the sizes that can be applied by the hot melt process and be removed with the $CO_2$ extraction process disclosed herein. Without being limited hereby, it is believed that co-solvents such as alcohols (water, ethanol, methanol, etc.), nitrites (acetonitrile) and the like ire useful in this process. Applicant has successfully demonstrated that a number of the sizes disclosed above can be applied with the hot melt process and then successfully extracted with $CO_2$.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for removing size from a yarn, comprising the steps of:

a)placing the yarn with said size into a pressurized environment of carbon dioxide, wherein said size comprises a fluorinated organic compound;

b) contacting the yarn with the carbon dioxide in the pressurized environment thereby dissolving substantially all of the size into the carbon dioxide; and c) removing substantially all of the carbon dioxide to produce a clean yarn.

2. The method of claim 1 wherein the carbon dioxide is provided as a liquid.

3. The method of claim 1 wherein the carbon dioxide is provided in a supercritical state.

4. The method of claim 1 wherein the size further comprises at least one compound selected from the group consisting of, adhesive, binder, wax, lubricant, antioxidant, stickiness inhibitors, and combinations thereof.

5. The method of claim 4 wherein the wax is selected from the group consisting of diblock species of the formula $F(CF_2)_x(CH_2)_yH$, wherein x is between about 4 and about 30 and y is between about 4 and about 30.

6. The method of claim 5 wherein the diblock species are selected from the group consisting of $F(CF_2)_8(CH_2)_{12}H$, $F(CF_2)_{10}(CH_2)_{12}H$, $F(CF_2)_{12}(CH_2)_8H$, $F(CF_2)_{12}(CH_2)_{14}H$ and $F(CF_2)_{12}(CH_2)_{18}H$.

7. The method of claim 4 wherein the lubricant is selected from the group consisting of polymers containing silicon.

8. The method of claim 7 wherein the polymers containing silicon are selected from the group consisting of poly (alkyl siloxanes) and polydimethyl siloxane.

9. The method of Claim 1 wherein the fluorinated organic compound is selected from the group consisting of perfluoroalkanes and perfluoroesters.

10. The method of Claim 1 wherein the fluorinated organic compound is selected from the group consisting of poly(perfluoro-alkyl acrylates), poly(perfluoro-n-octyl acrylate), poly(perfluoro-iso-octyl acrylate), poly(perfluoro-alkyl methacrylates), poly(perfluoro-n-octyl methacrylate), poly(perfluoro-iso-octyl methacrylate), poly(perfluoro-monocyclic acrylates), poly(perfluorocyclohexyl acrylate), poly(perfluoro-monocyclic methacrylates), and poly (perfluoro-cyclohexyl methacrylate).

11. The method of claim 1 further comprising the step of allowing the carbon dioxide to go to a gaseous state thereby separating the size material from the carbon dioxide and recycling the separated size.

12. The method of Claim 1 wherein the size further comprises a perfluoroalkanol.

13. A method of removing a $CO_2$-philic size compound having a fluorinated organic compound, the method comprising the step of contacting the sized substrate with a de-sizing compound comprising carbon dioxide, thereby removing the $CO_2$-philic size compound having the fluorinated organic compound therefrom.

14. A method for removing size from yarn woven into fabrics comprising the steps of:

a) rolling the sized fabric around a core;

b) providing carbon dioxide in a pressurized environment;

c) contacting the rolled fabric in the pressurized environment with carbon dioxide by directing the carbon dioxide through the rolled fabric thereby dissolving substantially all of the size into the carbon dioxide, said size comprising a fluorinated organic compound; and d) removing substantially all of the carbon dioxide to produce a de-sized fabric.

15. The method of claim 14 wherein the size comprises at least one compound selected from the group consisting of film former, adhesive, binder, wax, lubricant, antioxidant, stickiness inhibitors, and combinations thereof.

16. The method of claim 14 wherein the size comprises a perfluoroalcohol.

17. The method of claim 14 wherein the size is first applied to the yarn in a hot melt process.

* * * * *

UNITED STATES PATENT AND TRADEMARK OFFICE

CERTIFICATE OF CORRECTION

PATENT NO. : 5,863,298

DATED : 01/26/1999

INVENTOR(S) : Fulton et al.

It is certified that error appears in the above-identified patent and that said Letters Patent is hereby corrected as shown below:

In Column 1, in between the two paragraphs at line 35 please insert

In Column 2, line 55, please replace "F(CF2)$_{12}$" with --F($CF_2$)$_{12}$--.

In Column 8, line 31, please replace "0-0.05"" with --0-0.5"--.

In Column 10, line 37, please replace "...the like ire useful..." with --the like are useful--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*